US011253118B1

(12) United States Patent
Claudio

(10) Patent No.: US 11,253,118 B1
(45) Date of Patent: Feb. 22, 2022

(54) ODOR EXTRACTOR

(71) Applicant: Richard Claudio, White Settlement, TX (US)

(72) Inventor: Richard Claudio, White Settlement, TX (US)

( * ) Notice: Subject to any disclaimer, the term of this patent is extended or adjusted under 35 U.S.C. 154(b) by 44 days.

(21) Appl. No.: 16/920,685

(22) Filed: Jul. 4, 2020

(51) Int. Cl.
*A47K 13/30* (2006.01)
*E03D 9/052* (2006.01)

(52) U.S. Cl.
CPC ..... *A47K 13/307* (2013.01); *E03D 9/052* (2013.01)

(58) Field of Classification Search
CPC ..... E03D 9/05; E03D 9/052; A47K 13/307
USPC ..... 4/209 R
See application file for complete search history.

(56) References Cited

U.S. PATENT DOCUMENTS 3,763,505 A * 10/1973 Zimmerman ..... E03D 9/052 4/213
4,200,940 A * 5/1980 Buchanan ..... A47K 13/307 4/213
5,083,322 A * 1/1992 Goodman ..... E03D 9/052 4/213
5,345,617 A * 9/1994 Jahner ..... A47K 13/307 4/217
5,671,484 A * 9/1997 Lee, III ..... E03D 9/052 4/209 R
6,082,979 A * 7/2000 Friedman ..... E03F 1/006 4/431
6,351,855 B1 * 3/2002 Allen ..... E03D 9/05 4/213
6,567,994 B1 * 5/2003 Spurr ..... A47K 13/307 4/217
6,760,928 B1 * 7/2004 Rodriguez ..... A47K 13/307 4/217
8,490,221 B1 * 7/2013 Conde ..... E03D 5/105 4/213
9,103,104 B1 * 8/2015 Tom ..... E03D 9/052
2003/0192112 A1 * 10/2003 Ware ..... E03D 9/05 4/213
2005/0138720 A1 * 6/2005 Shim ..... A47K 13/307 4/213
2005/0273917 A1 * 12/2005 Lapossy ..... E03D 9/05 4/213
2006/0021120 A1 * 2/2006 Nickle ..... E03D 9/05 4/213
2007/0256219 A1 * 11/2007 Ellinger ..... E03D 9/052 4/213
2008/0086799 A1 * 4/2008 Bakhchadzyan ..... E03D 9/052 4/213
2009/0089920 A1 * 4/2009 Quick ..... E03D 9/052 4/214
2009/0158515 A1 * 6/2009 Bruno ..... E03D 9/052 4/348

(Continued)

*Primary Examiner* — Benjamin R Shaw
(74) *Attorney, Agent, or Firm* — Wilson Daniel Swayze, Jr.

(57) ABSTRACT

An extractor device to extract unwanted odors from a conventional toilet may include a seat mounting device configured to mount on a toilet seat of the conventional toilet; an input noise reduction muffler assembly connected to the seat mounting device to eliminate noise transmitted from the seat mounting device; a vacuum device in fluid connection with the seat mounting device; the vacuum device including a ring compression blower to generate a vacuum; an output noise reduction assembly to reduce noise from the vacuum device.

6 Claims, 4 Drawing Sheets

(56) References Cited

U.S. PATENT DOCUMENTS

| | | | | |
|---|---|---|---|---|
| 2012/0054950 | A1* | 3/2012 | Abunameh | E03D 9/05 4/348 |
| 2012/0090081 | A1* | 4/2012 | Yang | E03D 9/052 4/213 |
| 2014/0298576 | A1* | 10/2014 | Gallardo Chaparro | E03D 9/05 4/213 |
| 2015/0074886 | A1* | 3/2015 | Wu | E03D 9/052 4/213 |
| 2015/0107009 | A1* | 4/2015 | Quick | E03D 9/05 4/348 |
| 2018/0148916 | A1* | 5/2018 | Kim | E03D 9/05 |
| 2019/0330832 | A1* | 10/2019 | Gong | E03D 9/05 |
| 2021/0101106 | A1* | 4/2021 | Clement | A47K 13/307 |
| 2021/0129073 | A1* | 5/2021 | Liao | E03D 9/052 |

* cited by examiner

ODOR EXTRACTOR

FIELD OF THE INVENTION

The present invention relates to an odor removal device and more particularly to an odor extractor device to be used in conjunction with a standard toilet seat.

BACKGROUND

The use of all common types of toilets produces unpleasant odors. The conventional way to ventilate a bathroom, restroom or other facility containing a toilet is by the use of an exhaust fan often installed in the ceiling of the bathroom, which typically requires about forty to one-hundred-eighty watts of electrical power to operate. In order to remove unpleasant odors, such a ceiling fan must operate for several minutes or longer to remove the entire volume of air within the bathroom and exhaust it to the exterior of the home or other building.

Such conventional exhaust fans are disadvantageous for many reasons. Initially, such ventilating fans use a substantial electrical power and, thus, are expensive to operate. When such an exhaust fan is operating there is no specific airflow generated to carry away odors from the area surrounding the toilet or from within the toilet bowl. Thus, such an exhaust fan must remove a substantial volume of air to the exterior of the home or other structure that has either been heated or, alternatively, which has been cooled depending on the locale and weather conditions. Accordingly, the operation of such conventional bathroom exhaust fans is energy inefficient and also generates an unpleasant noise for others in the vicinity.

Another related problem is presented by elderly, infirm and physically disabled persons who may be unable to use a standard toilet and are required to use a portable commode positioned near a bed or in another living area where there is no exhaust fan in proximity to the commode. The odors emanating from a portable commode are more problematic than those associated with a standard toilet because the waste materials cannot be flushed away.

The odor devices of the prior art tend to be extremely noisy resulting in complaints from users about the excess noise causing them to disconnect the odor devices.

SUMMARY

The extractor device of the present invention can be installed anywhere in a residential or commercial building, and distance between the toilet and the extractor device can be as much as 100 feet. In many circumstances, the extractor device will be installed in a garage or basement or possibly outside of the residential or commercial building and may include a weatherproof cabinet in order to protect the extractor device of the present invention. The extractor device is easily removable if replacement should ever be required. The extractor device of the present invention may be installed in new buildings or retrofitted in existing buildings.

In operation, when the toilet is being used, a timer device activates the extractor device and generates a vacuum. The extractor device operates for a predetermined period of time and then automatically shuts off.

The present invention includes a ring compressor side channel blower which is operated reversed in order to generate a vacuum and includes a noise removing muffler on the input and output sides to achieve almost total silence operation when the extractor device is operated. The amount of vacuum may be regulated to achieve a constant vacuum when the extractor device is positioned close to the toilet or when the extractor device is positioned at a distance from the toilet. The extractor device of the present invention generates significantly less noise than the standard in the ceiling exhaust fan.

The ring compressor side channel blower motor generates a vacuum airflow resulting in a noise factor which is almost silent in the bathroom toilet seat area and also in a location where the extractor device is mounted such as the attic and garage. The extractor device of the present invention uses very little power and little corresponding expense. The tubing of the present invention may be relatively small, leaving a small footprint after installation.

The present invention eliminates the need for chemicals/fragrance/propellants, and the present invention instantly removes the odor eliminating the need for a courtesy flush to manually eliminate the bad order. Thus the present invention can save water. The present invention eliminates the need for a chemical toilet seat and illuminates the corresponding need for a charcoal filter. The toilet seat of the present invention gives the appearance of a conventional toilet seat while the connections can be hidden under the basin of the toilet.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
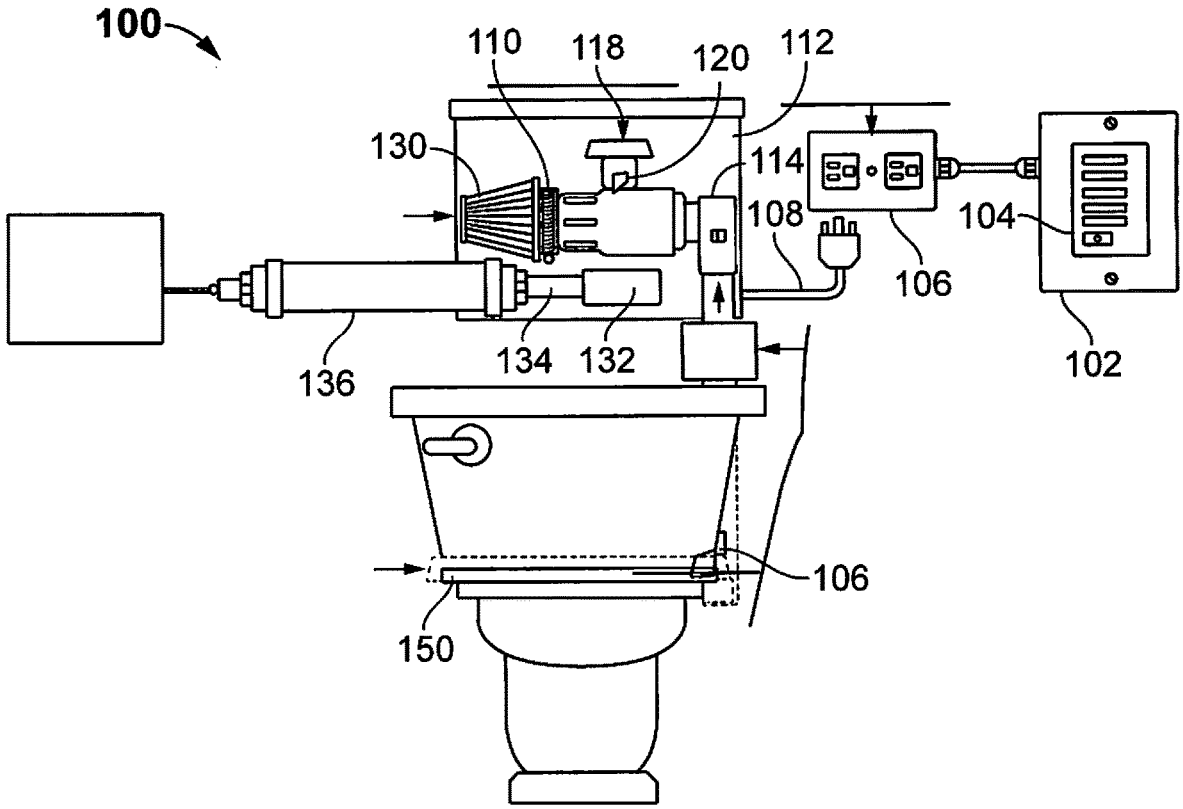
FIG. 1 illustrates a block diagram of the odor extractor device of the present invention.
Figure 2:
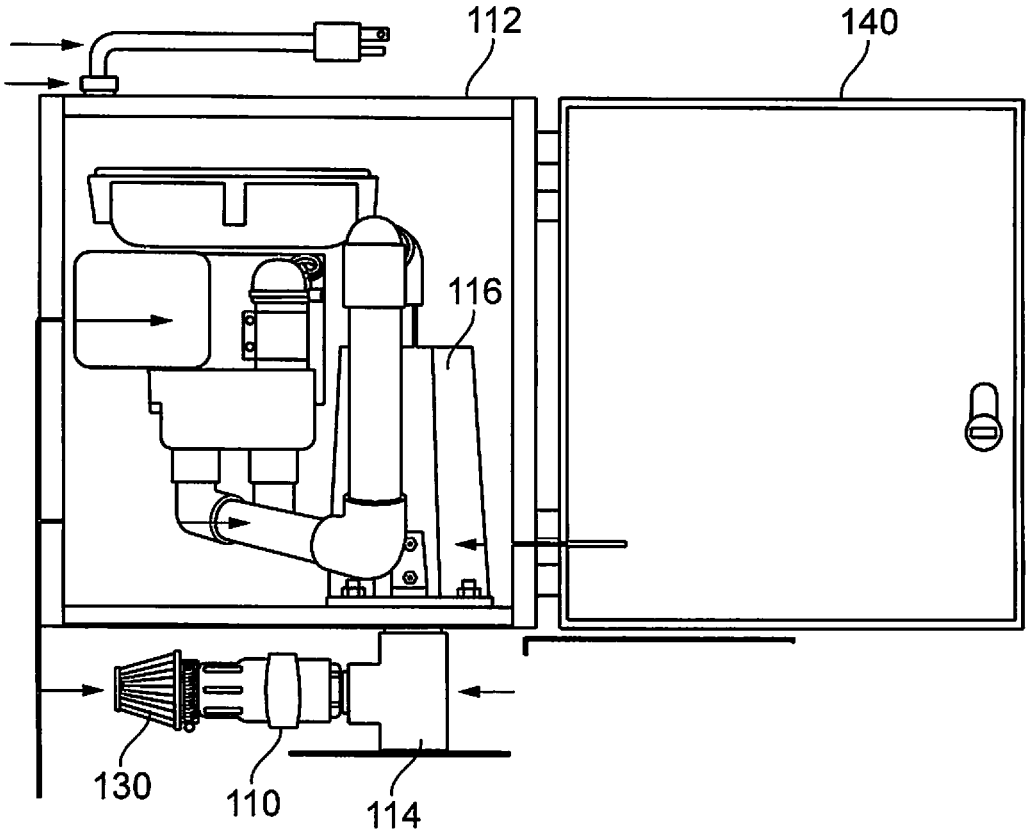
FIG. 2 illustrates a side view of the extractor control box of the present invention.

FIG. 1 illustrates a diagram of the odor extractor device 100 of the present invention which may include a timing device 102 to allow the odor extractor device 100 run for a predetermined time which may be increased or decreased by the user through the input screen 104. The extractor device 100 may activate the timing device 102 by a sensor 106 which may be positioned in the area to be used as a seat by the user and may be activated by the user. The extractor device 100 may plug into the power outlet 106 which is controlled by the timing device 102 to supply the extractor device 100 with power through the electrical cord 108. The power outlet 106 may be connected to the vacuum generator 110 which may be positioned or housed in the extractor device cabinet 112. An inlet passage way 114 may connect the odor causing portion of the toilet to the vacuum generator 110. As shown in FIG. 2, the inlet passage way 114 may be connected to a noise reduction muffler assembly 116 which in turn is connected to the vacuum generator 110.

The vacuum generator 110 may be controlled by a vacuum controller 118 which allows the user to control the amount of vacuum generated by the vacuum generator 110 and may include a flow valve 120 to restrict or enhance the flow of vacuum generated. Attached to the vacuum generator 110 may be a dust eliminating device 130 such as an airfilter for example a dust filter which may be a truncated cone shaped filter to eliminate foreign particles such as dust to enter the vacuum generator 110.

The vacuum generator 110 may include a output port 132 to output the odor, and the output port 132 may be connected to a connecting passage way 134 which connects the vacuum generator 102 and exhaust noise reducing muffler 136 which eliminates unwanted sound from the vacuum generator 102 and outputs the odor to the atmosphere.

FIG. 2 illustrates a side view of the extractor control box/cabinet 112 of the present invention which may include a cabinet door 140 which may open and close in order to gain access to the interior of the extractor control cabinet 112, and the vacuum generator 110 is positioned beneath the extractor control box/cabinet 112 being connected to the input passageway 114. The dust eliminating device 130 which may be a cone shaped filter. Positioned within the extracting device cabinet 112 is the inlet noise muffler 116 and the ring compressor blower assembly 142 including the ring compressor blower 144 to reduce noise especially from the toilet flushing. FIG. 2 illustrates a seat mounting device 150 to be mounted on a conventional toilet seat and includes an inlet port to accept the odors generated from the toilet. The seat mounting device 150 and the seated user provides a seal so that the vacuum can be established.

Figure 3:
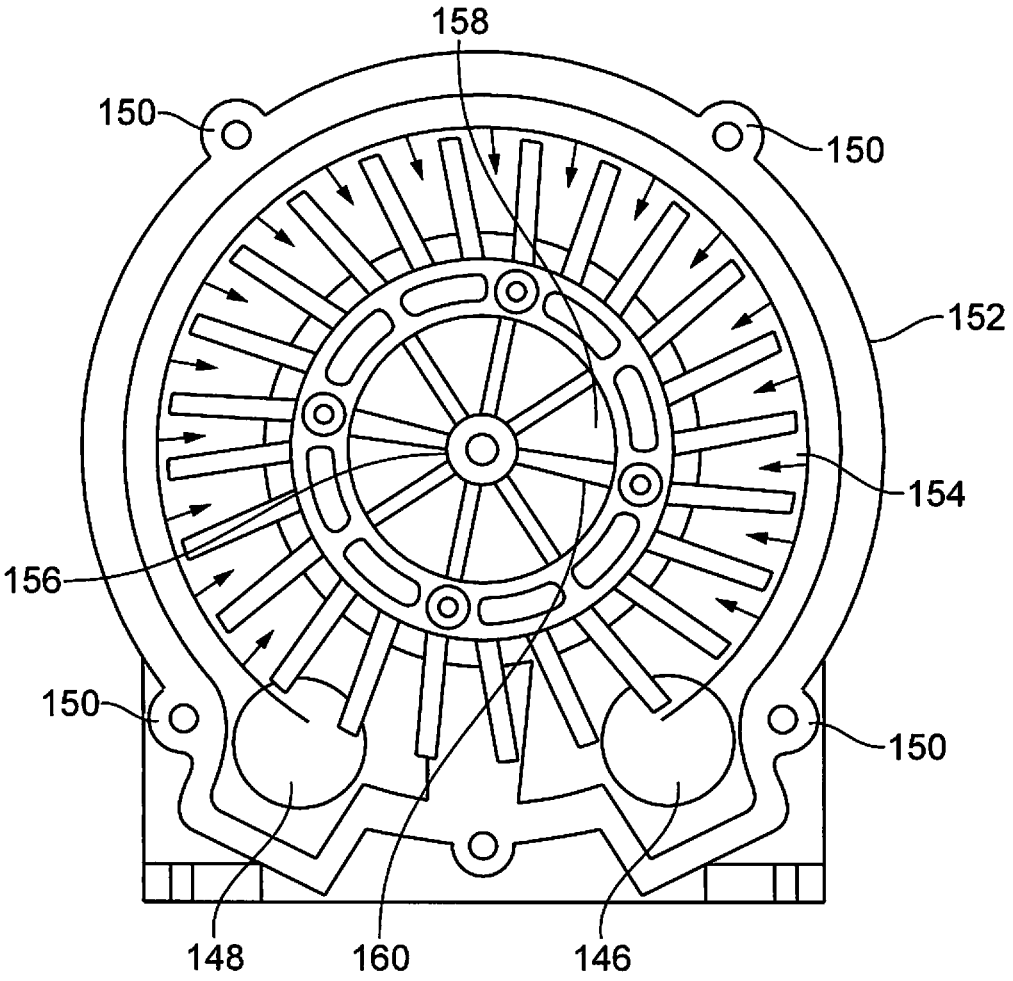
FIG. 3 illustrates a cross-section of the ring compressor blower.

The ring compressor blower 144 as shown in FIG. 3 includes a input port 146 to input odor which may be formed with a fluid such as air and in output port 146 to output the odor. The ring compressor blower 144 may include mounting devices 150 to mount the ring compressor blower 144 and may include a multitude of vanes 154 to produce the vacuum when the blower 144 is rotating. The ring compressor blower 144 may include a center hub 156 and a ring 158 and ribs 160 to connect the central hub 156 and the ring 158. The ring compressor blower 144 may be formed within a housing 162.

Figure 4:
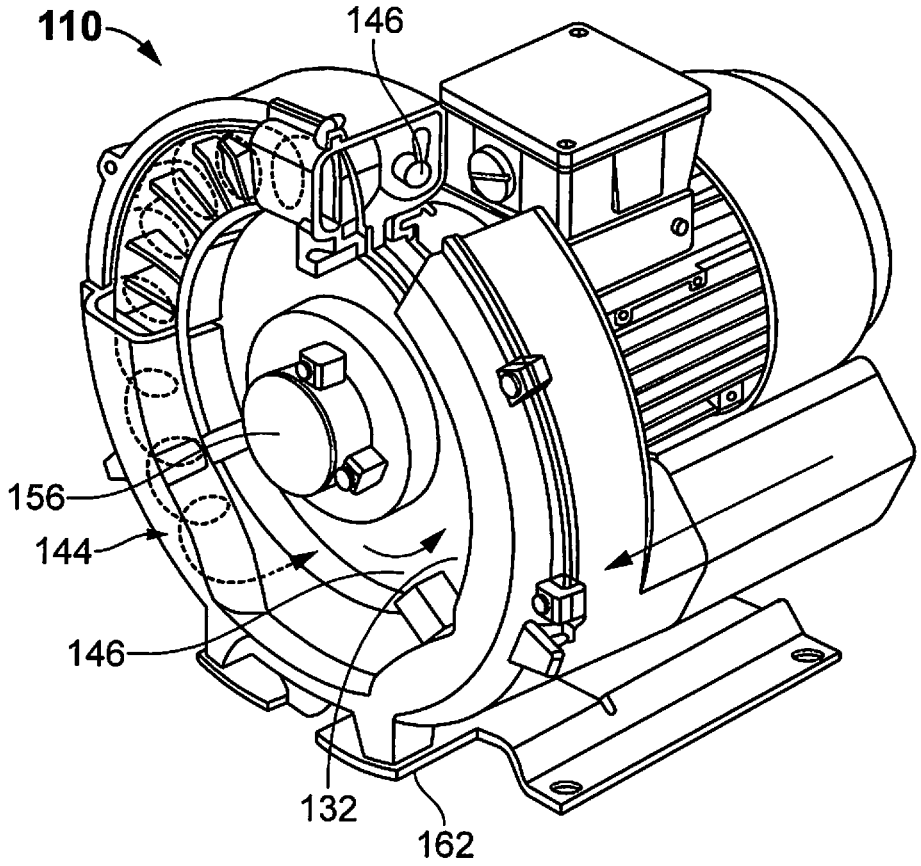
FIG. 4 illustrates a partial cross-sectional view of the vacuum generator of the present invention.

FIG. 4 illustrates the vacuum generator 110 may including a output port 132 to output the odor, and the output port 132 may be connected to a connecting passage way (not shown in FIG. 4) which connects the vacuum generator 102 and exhaust noise reducing muffler (not shown in FIG. 4) which eliminates unwanted sound from the vacuum generator 102 and outputs the odor to the atmosphere.

FIG. 4 illustrates the ring compressor blower 144 includes a input port 146 to input odor which may be formed with a fluid such as air and an output port 146 to output the odor. The ring compressor blower 144 may include mounting devices (not shown in FIG. 4) to mount the ring compressor blower 144 and may include a multitude of vanes (not shown in FIG. 4) to produce the vacuum when the blower 144 is rotating. The ring compressor blower 144 may include a center hub 156 and a ring (not shown in FIG. 4) and ribs (not shown in FIG. 4) to connect the central hub 156 and the ring 158. The ring compressor blower 144 may be formed within a housing 162.

In operation, odor which may be a fluid such as air is drawn into the input passageway 114 and enters the ring compressor blower 144 where the vacuum is generated and the odor flows out the output passageway 124. The dust eliminating device 130 eliminates dust from entering the vacuum generator 110 and the odor is output to the atmosphere. The noise reduction muffler assembly 116 reduces the noise as well as the exhaust muffler 131.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An extractor device to extract unwanted odors from a conventional toilet, comprising:

a seat mounting device configured to mount on a toilet seat of the conventional toilet;

an input noise reduction muffler assembly connected to the seat mounting device to reduce the harmonic noise the vacuum/suction line makes;

a vacuum device in fluid connection with the seat mounting device;

the vacuum device including a ring compression blower to generate a vacuum;

an output noise reduction assembly to reduce noise from the vacuum device.

2. An extractor device to extract unwanted odors from a conventional toilet as in claim 1, wherein the extractor device is controlled by a timer control device to shut down the extractor device after a predetermined time.

3. An extractor device to extract unwanted odors from a conventional toilet as in claim 1, wherein the vacuum device includes a flow valve to control the amount of vacuum flow through the extractor device.

4. An extractor device to extract unwanted odors from a conventional toilet as in claim 1, wherein the vacuum device is connected to a dust eliminating device to eliminate particles from the vacuum flow.

5. An extractor device to extract unwanted odors from a conventional toilet as in claim 4, wherein the dust eliminating device is a truncated cone shape.

6. An extractor device to extract unwanted odors from a conventional toilet as in claim 2, wherein the timer control device includes a programmable screen.

* * * * *